US006206810B1

(12) United States Patent
Alessandri

(10) Patent No.: US 6,206,810 B1
(45) Date of Patent: Mar. 27, 2001

(54) EXERCISE MACHINE

(75) Inventor: Nerio Alessandri, Longiano (IT)

(73) Assignee: Techogym S.r.l., Gambettola (IT)

( * ) Notice: Subject to any disclaimer, the term of this patent is extended or adjusted under 35 U.S.C. 154(b) by 0 days.

(21) Appl. No.: 09/268,665

(22) Filed: Mar. 16, 1999

(30) Foreign Application Priority Data

Mar. 17, 1998 (IT) ..... B098A0169

(51) Int. Cl.[7] ..... A63B 21/062
(52) U.S. Cl. ..... 482/98; 482/99
(58) Field of Search ..... 482/94, 98–103; D21/675

(56) References Cited

U.S. PATENT DOCUMENTS 3,647,209 * 3/1972 La Lanne ..... 482/99
4,606,540 * 8/1986 Chin Sen ..... 482/96

FOREIGN PATENT DOCUMENTS 9108981 11/1991 (DE) .
9416610 1/1995 (DE) .
2052274 1/1981 (GB) .

* cited by examiner

*Primary Examiner*—John Mulcahy
(74) *Attorney, Agent, or Firm*—Pillsbury Madison & Sutro LLP

(57) ABSTRACT

Exercise machine (10) wherein a frame (20) is provided with at least one upr-ght (21) substantially vertical and prismatically shaped; the upright (21) presenting at least one elongated body (26) able to serve as a guide to a pack (P) of flat bodies (31) able to be actuated longitudinally for the execution of training exercises; the upright (21) being externally delimited by a longitudinal shell (22) shaped prismatically and laterally facing the flat bodies (31); at least one plate (14) engaging the upright (21) in sliding fashion to isolate the flat bodies (31) from the outside in co-operation with the shell (22); coupling organs being provided inside the shell (22) to connect said upright and the elongated body (26) rigidly to each other according to a longitudinal direction.

16 Claims, 3 Drawing Sheets

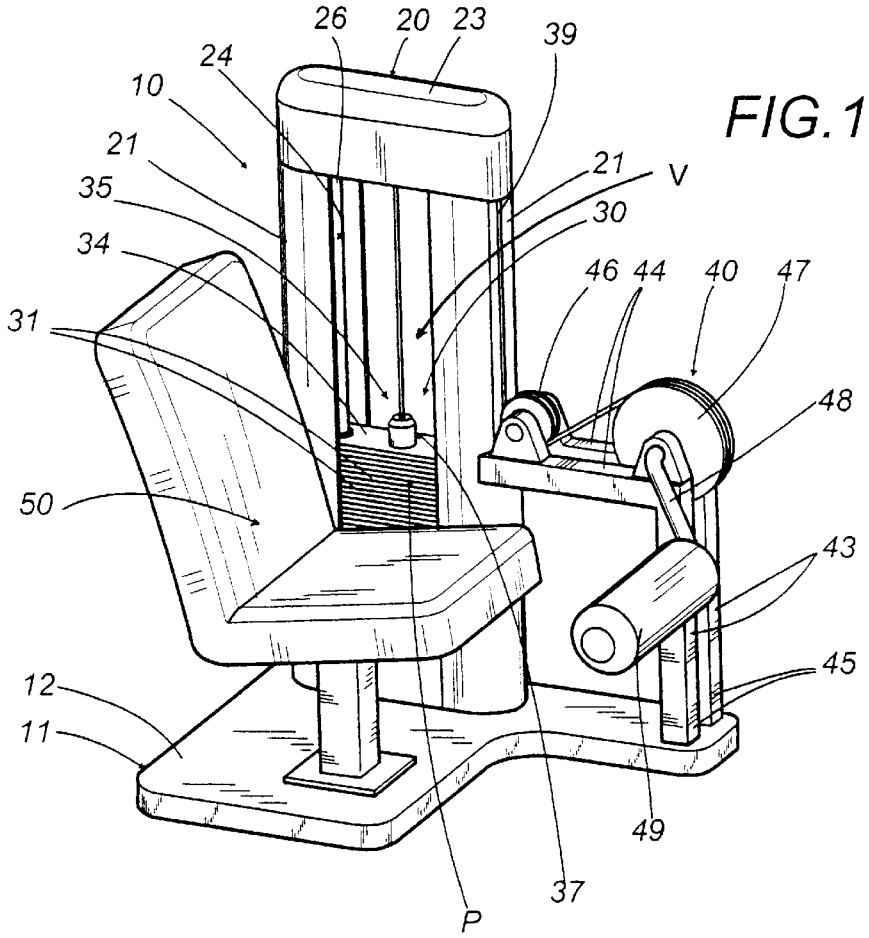
FIG.1
FIG.3
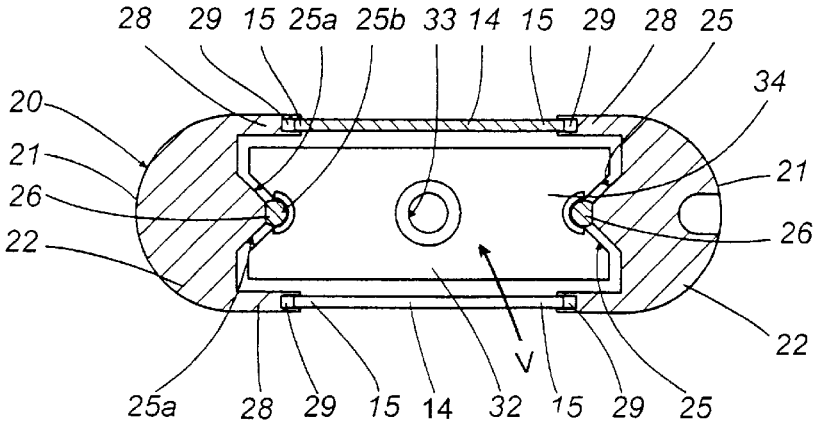

EXERCISE MACHINE

BACKGROUND OF THE INVENTION

The present invention relates to an exercise machine, effectively employable for strengthening and/or rehabilitation purposes.

Every exercise machine comprises a plurality of devices co-operating together to allow the execution of exercises aimed at training one or more regions of the body.

Among such devices, always present are a frame, a load unit, a seat, and an articulated device employable by a user to exchange power with the load unit, naturally for training purposes. The frame supports a platform and comprises a frame obtained by welding metal pipes, previously cut to measure. This frame presents a base portion that realizes the support for the seat, and an upper portion that supports and normally delimits the load unit.

The latter is traditionally of the gravity type, and realized by means of a plurality of metal plates of a determined weight. The plates are stacked together, and constrained to slide vertically by means of two rods, in turn vertically supported by the frame. In this case, the rods-plates assembly defines a sliding guide device wherein the rods define the guide and the plates the slide. Naturally, the user has the possibility of isolating on each occasion a set number of plates to form a load of a given size. This load can be actuated by the user through a flexible cable variously passing around pulleys supported by the frame. Traction on the flexible cable is exercised by means of handles, bars or the like, and during the operation of the machine the plates defining the load are alternatively lifted and lowered with respect to a rest position. This position is reached at the end of the exercise, or in the case wherein, accidentally, the user releases the handle when the plates are still lifted. Highly trained athletes can reach the ability of lifting loads exceeding 100 kilograms.

Therefore, for safety reasons, the load unit is isolated from the outside by means of a metal grate. This grate is fastened to the pipes of the frame in a removable manner by means of a plurality of connecting elements, such as screws and/or rivets. Each exercise machine is specialized according to the type of exercise that such a machine must perform and it presents a frame of a different kind, with different dimensions.

Exercise machines like the ones described above present a mechanical structure obtained by assembling very simple components. This constructive aspect allows for a significant reduction in raw material costs, but considerably complicates the productive process: the need to realize the frame starting from a plurality of metal tubes forces the completion of a large number of metalwork interventions, at the end whereof painting must be performed. Moreover, the fact that the structure of the machine is welded considerably complicates maintenance activities, such as the replacement or upgrading of the number of plates equipping the load unit.

SUMMARY OF THE INVENTION

The aim of the present invention is to realize an exercise machine that is free of the drawbacks described above.

A further aim of the present invention is for the part of frame reserved to the load unit to be of particularly rapid and economical construction, and substantially free of welded components.

According to the present invention an exercise machine is realized comprising a frame provided with at least an upright, vertical and prismatically shaped; said upright supporting at least an elongated body able to serve as a guide and a pack of flat bodies able to be actuated longitudinally for the execution of training exercises; each of said flat bodies presenting a portion coupled transversely to said elongated body, to render said flat bodies angularly fixed and free to slide with respect to said elongated body; at least one plate supported by said upright in a position facing said flat bodies to isolate them from the outside; characterized in that said upright is externally delimited by a prismatically shaped longitudinal shell, able laterally to cover said coupled portions; longitudinal coupling means being provided to connect rigidly together said upright and elongated body; said plate being delimited laterally by at least a substantially rectilinear longitudinal border; said shell presenting at least a longitudinal seat slidingly engaged by said longitudinal border.

BRIEF DESCRIPTION OF THE DRAWINGS

The invention shall now be described with reference to the accompanying drawings, which illustrate a non limiting embodiment, in which:

FIG. 1 is a schematic perspective view of a first preferred non limiting embodiment of a machine realized according to the prescriptions of the present invention;

FIG. 3 is an enlarged scale plan view, with some parts removed for the sake of clarity, of FIG. 1;

DESCRIPTION OF THE PREFERRED EMBODIMENT

In FIG. 1, the number 10 indicates, in its entirety, an exercise machine effectively employable by a user to perform training or rehabilitative exercises, without thereby losing its general nature.

Figure 2:
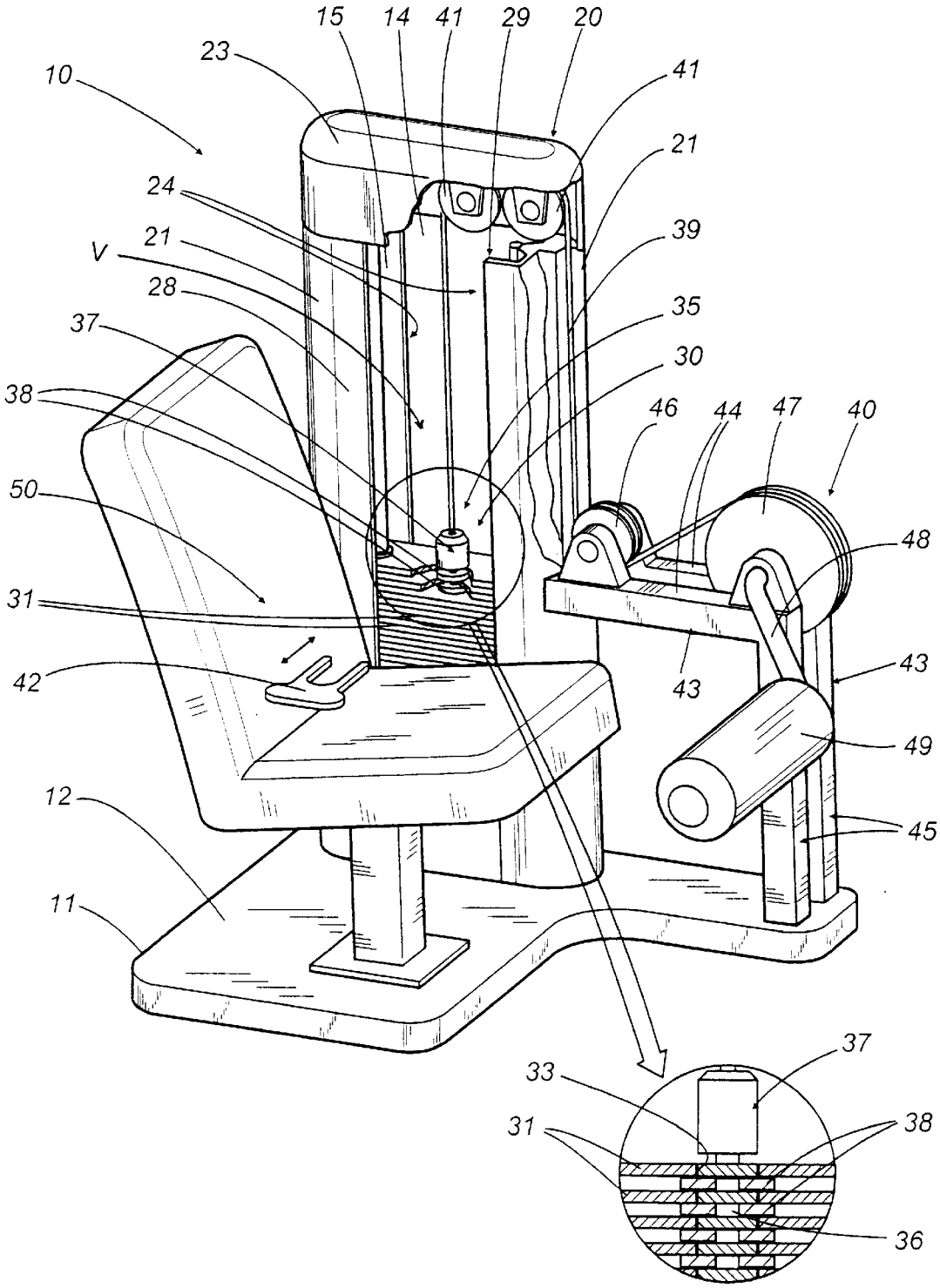
FIG. 2 is an enlarged scale perspective view, with some parts removed for the sake of clarity, of FIG. 1.

With reference to FIGS. 1 and 2, the machine 10 is provided with a frame 11 comprises a platform 12 and a modular metal structure or frame 20 positioned above the platform 12. Such frame 20 delimits in its interior a load unit 30 and supports an articulated device 40 which can be actuated by the user to train the femoral muscles. This articulated device 40 is able to cooperate with the unit 30 itself in such a way as to allow the exchange of power with the machine 10. The machine 10 lastly comprises a seat 50 set alongside the frame 20 to support a training user by means of articulated device 40.

The frame 20 is provided with at least one upright 21 substantially vertical and prismatically shaped. In particular the frame 20 comorises two uprights 21 positioned to face each other, each of which is delimited externally by a shell 22 having C-shaped cross section and concavity facing the other upright 21. The two uprights 21 isolate between them a volume V of determined shape and constant section, thus also presenting prismatic shape. This volume V is closed at the top by a lid 23 which, in turn, is connected removably to the uprights 21 themselves, in particular by means of threaded coupling. The unit 30 presents, within the volume V, a plurality of flat plates 31 of substantially parallelepiped shape, and made of metal material of a set thickness. These plates 31 are stacked together inside the aforementioned volume V to form a so-called "weight pack " P. This weight pack P can be alternatively lifted and lowered by a user during training by means of the device 40. Each upright 21 is provided with a device 24 to guide the plates 31 along the vertical direction, which shall be better described farther on. With particular reference to FIG. 3, the device 24 comprises a rib 25 obtained in a single piece with the shell 22. This rib 25 is laterally delimited by two converging sections 25*a*, mutually joined by a substantially flat surface 25*b*, whose extension is equal to the extension of the upright 21. This surface 25*b* serves as a bearing surface for a rod 26 which is connected in a manner that is removable by loosening connecting means comprising a plurality of horizontally mounted screws (known and not shown) equally distributed along the respective upright 21. Thus the rod 26 and the shell are mutually connected through the interposition of the rib 24. Such screws allow to realize a mating contact between the rod 26 and the rib 24, and hence can be considered as longitudinal connecting means for the rod 26 itself.

The plates 31 belong to the load unit 30, and each of them is delimited by a profile that follows the negative of the shape of the cross section of the volume V itself. In particular, each plate 31 presents a central portion 32 presenting a servicing hole 33 of a determined diameter, centrally positioned. Each plate 31, moreover, presents, in correspondence with each of the two uprights 21, a matched end portion 34 delimited by an open and concave profile, able to define a transverse seat for the rod 26. In particular each portion 34 faces and is coupled to the rods 26 of the two uprights 21. Thus each plate 31 is connected to the respective rod 26 in an angularly fixed manner and is free to slide vertically between the uprights 21.

With particular reference to FIGS. 1 and 3, each shell ends with two longitudinal sections 28, positioned at opposite sides to the rod 26. The two sections 28 laterally cover the portions 34 of the plates 31, and co-operate with a pair of substantially parallelepiped plates 14 to close the volume V at the front and rear. In particular, each plate 14 is positioned between the two front/rear sections 28, and is delimited by two longitudinal borders 15 which engage, each, a longitudinal seat 29 obtained in the end position on each section 28.

With reference to FIG. 2, the load unit 30 presents a latching device 35 which can be activated by the articulated device 40 for the lifting and subsequent lowering of the plates 31 for training purposes. This latching device 35 comprises a pin 36 that extends vertically inside the holes 33, and presents an extension approximating and being slightly larger than the height of the totality of the plates 31. Such pin 36 is delimited at the top by a hollow organ 37, and it presents, along the body, a plurality of rings 38 of a diameter that approximates and is slightly smaller than the diameter of the holes 33. Such rings 38 are uniformly distributed and separated in twos by a distance equal to the thickness of the plates 31. The device 35 comprises a flexible cable 39, normally made of metallic or textile material with negligible stretching, provided with an end engaging the organ and closed by a known fastening element, not shown herein. The cable 39 presents, on the side opposite Lo the organ 37, an end connected to the articulated device 40, for controlling the position of the isolated plates 31 for training purposes.

The latching device 35 further comprises a pair of pulleys 41 positioned on the side of the articulated device 40. The two pulleys 41 are supported by the lid 23 in an axially fixed and angularly rotating manner, in such a way as to pass the cable 39 on the exterior of the lid 23 towards the articulated device 40. In parLicular, the exit of the cable 39 towards the outside is enabled by the fact that the upright 21 positioned on the side of the articulated device 40 externally presents a groove freely engaged by the cable 39 itself.

The device 35, moreover, comprises a locking organ able to be selectively fastened on the pin 36 in such a way as to isolate a set number of plates 31, and able to delimit a set number of plates 31 for the definition of the training weight pack P. The aforementioned locking organ is realized by means of a fork shaped body 42 provided with a substantially U-shaped seat with transverse dimensions approximating the diameter of the body of the pin 36 between two rings 38. Clearly, by placing the body 42 between two rings 38 positioned between two plates 31 stacked together in rest position, the weight pack P is divided into two groups of plates 31. The top group lying between the organ 37 and the body 42 itself is thereby rendered substantially integral to the pin 36 and therefore is employable for training purposes by means of cable 39.

With reference to FIG. 2, the frame 20 comprises a pair of tubular bodies 43 bent to an L shape and placed alongside each other and at the side of the legs of a user positioned on the seat 50. Each tubular body 43 presents a horizontal section 44 connected to the upright 21 positioned to the right in FIG. 2, and a vertical section 45 bearing down on the platform 12. The two sections 44 support in axially fixed and angularly rotating manner a pulley 46 and a cam 47 of the device 40, around the periphery whereof is wound the cable 39. The sections 44 further support in angularly rotating and axially fixed manner, to the right of the cam 47 in FIG. 2, a lever 48 coaxial to the cam 47, provided with a tubular padding 49. The lever 48 is L shaped and it presents a rectilinear section positioned facing the legs of a user set on the seat 50 in such a way that it can be actuated with alternating rotatory motion to train the lower limbs. Naturally, the cable 39 terminates with a respective end integrally connected, in known fashion, to the cam 47.

Use of the machine 10 is easily understandable based on the description orovided above and requires no further explanation.

It should be noted that the particular conformation of the uprights 21 allows them to be manufactured with extrusion or forging processes. Such technological processes allow to employ light materials to obtain hollow tubular bodies with particularly advanced mechanical characteristics. In particular, using materials such as light alloys (for instance aluminum alloys) or so-called composite materials (such as glass and carbon fibbers) allows greatly to simplify the assembly and transport of the exercise machines inside and outside manufacturing facilities, with great economic advantages.

To be stressed is the great assembly ease that allows to obtain a weight pack P protected by plates with very simple operations, such as that of inserting the plates directly on the uprights after placing them on the platform in the exercise position. The frame can be assembled directly at the user's home without requiring any welding operations.

Maintenance operations such as the replacement of pin 36 with one of different length, in order to have available a weight pack P comprising a higher number of plates is immediate, given that access to the volume V is obtained simply by extracting the plates 14 upwards.

It is superfluous to specify that the basic structure of the machine 10 will be specialized on a case by case basis to take into account the specifics of the bodv region to be trained. In any case different frames will share the parts relating to the respective weight packs P, differing from each other only in the vertical extension of the uprights 21. This aspect also contributes to lower manufacturing costs.

Constructing the uprights 21 with composite material further allows to eliminate the painting operation. Otherwise, operating with light alloys or aluminum, the painting problem can be solved through a work process that improves their mechanical characteristics such as shot-peening.

Lastly, it is clear that the machine 10 described and illustrated herein can be subject to modifications and variations without thereby departing from the protective scope of the present invention.

Figure 5:
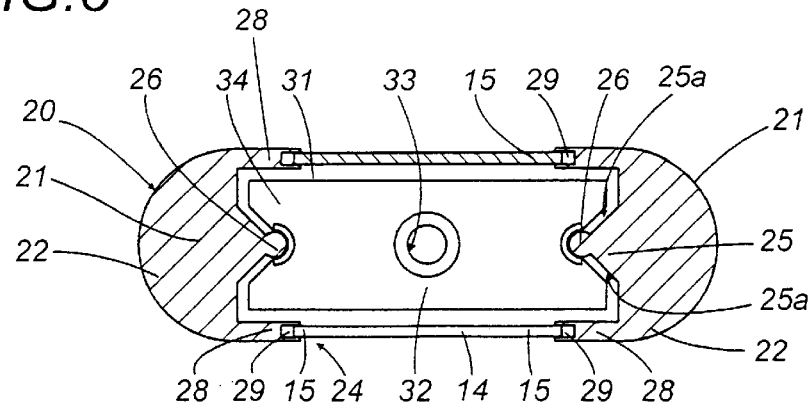
FIG. 5 is an enlarged scale plan view, with parts removed for the sake of clarity, of a second preferred embodiment of FIG. 3.

For instance, with reference to FIG. 5, the particular shape of the uprights 21 allows their realization by extrusion, constructing dies that integrate a cavity able to define the negative of the section of the rod 26. In this way the shell 24, the rib 25 and the rod 26 shall be mutually integral (obtained from the same piece). The number of pieces to be manufactured for each machine 10 will decrease, thereby facilitating assembly operations and inventory management. In this case the upright 21 presents substantially E-shaped cross section, with the rod 26 defining the center tooth of the E.

Figure 4:
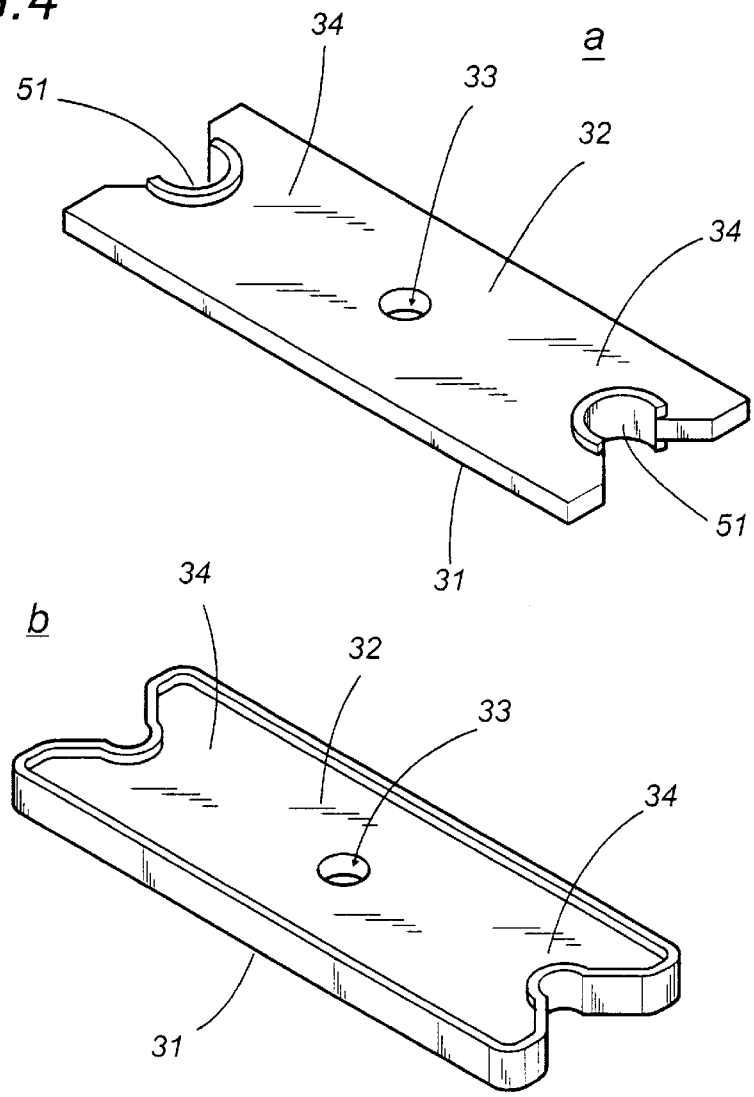
FIG. 4 is an enlarged scale plan view, with some parts removed for the sake of clarity, of a detail excerpted from FIG. 3.

Moreover, in order to limit any problems with sliding on the central tooth of the E, the plates 31 can be modified with reference to FIGS. 4*a* and 4*b*. In these cases, simply with friction reducing means obtained by coating each of the portions 34 with a sleeve 51 open in correspondence with the tooth of the E, and made of material presenting high sliding ability in contact with a metal surface (for instance, polytetra-fluoro-ethylene, or PTFE, as in FIG. 4*a*). Better yet would be to coat the plates 31 with similar materials (FIG. 4*b*), at the same time obtaining a quieter operation of the machine 10, thanks to the dampening of plate 31—plate 31 impacts.

The invention thus conceived may be subject to numerous modifications and variations, without thereby departing from the scope of the inventive concept. Moreover, all components can be replaced with technically equivalent elements.

What is claimed:

1. Exercise machine comprising a frame provided with at least an upright substantially vertical and prismatically shaped; said upright supporting at least an elongated body able to serve as a guide to a pack of flat bodies able to be actuated longitudinally for the execution of training exercises; each of said flat bodies presenting a portion transversely mated to said elongated body, to render said flat bodies angularly fixed and free to slide with respect to said elongated body; at least a plate supported by said upright in a position facing said flat bodies to isolate them from the outside; wherein said upright is externally delimited by a prismatically shaped longitudinal shell, able laterally to cover said mated portions; longitudinal coupling means being provided to connect said upright and elongated body rigidly together; said plate being laterally delimited by at least one substantially rectilinear longitudinal border; said shell presenting at least a longitudinal seat slidingly engaged by a said longitudinal border.

2. Machine according to claim 1, wherein said shell and said elongated body are rigidly connected together through the interposition of a longitudinal rib, realized from the same piece as said shell; substantially rectangular sections being obtained from the same piece as said shell; each said mated portion having its plan form delimited by an open profile to form a seat facing said elongated body, in such a way that each said flat body is angularly fixed and free to slide vertically on the elongated body itself.

3. Machine according to claim 2, wherein said connecting means of said elongated body comprise removable connecting organs.

4. Machine according to claim 2, wherein said elongated body is a metal rod presenting at least one rectilinear section set in a position of mated contact with said rib.

5. Machine according to claim 2, wherein said coupling means comprise welded connections between said elongated body and said rib.

6. Machine according to claim 2, wherein said upright is of the monolithic type, presenting said shell, rib, and elongated body obtained from a single piece.

7. Machine according to claim 6, wherein said shell presents a substantially C shaped cross section, and is longitudinally delimited by said two substantially rectangular longitudinal sections; each of said longitudinal sections being, in turn, delimited by said longitudinal seat.

8. Machine according to claim 7, wherein said upright is a product obtained by extrusion of a metallic material.

9. Machine according to claim 7, wherein said upright is made of light alloy.

10. Machine according to claim 9, wherein said upright presents substantially E-shaped cross section, said rib together with said elongated body representing the central leg of the E.

11. Machine according to claim 2, wherein said upright is made of composite material.

12. Machine according claim 1, wherein said frame comprises a pair of uprights, and a connecting organ positioned between them and above said pack of flat bodies; in such a way as to refer them with respect to one another and to connect them rigidly.

13. Machine according to claim 12, wherein said connecting body comprises a lid of the boxed type to house internally, in a manner freely ro-Lating and axially fixed, at least one transmission pulley for a flexible organ; said flexible organ being connected to said pack of flat bodies for the respective actuation along said elongated body.

14. Machine according to claim 12, wherein each said flat body presents a pair of mated portions, each whereof being slidingly coupled to a respective elongated body; each said flat body presenting respective friction reducing means able to favor the free sliding of the flat body itself on said elongated bodies.

15. Machine according to claim 14, wherein said friction reducing means comprise inserts of plastic material presenting high sliding ability in contact with the respective metal rods in correspondence with the respective mated portions.

16. Machine according to claim 14, wherein the friction reducing means comprise a coating of said flat bodies, said coating being made of material presenting high sliding capability in contact with said metallic rods.

* * * * *

UNITED STATES PATENT AND TRADEMARK OFFICE

CERTIFICATE OF CORRECTION

PATENT NO. : 6,206,810 B1
DATED : March 27, 2001
INVENTOR(S) : N. Alessandri

It is certified that error appears in the above-identified patent and that said Letters Patent is hereby corrected as shown below:

Title page,
Item [73], Assignee, delete "Techogym" and insert -- Technogym --

Signed and Sealed this

Tenth Day of June, 2003

JAMES E. ROGAN
*Director of the United States Patent and Trademark Office*